United States Patent [19]

Rowe et al.

[11] Patent Number: 4,935,865

[45] Date of Patent: Jun. 19, 1990

[54] COMPUTER CONTROLLED ELECTROPOLISHING SYSTEM

[75] Inventors: Mark S. Rowe; Charles E. Harper, Jr., both of Fairborn; Charles R. Underwood, Dayton, all of Ohio

[73] Assignee: The United States of America as represented by the Secretary of the Air Force, Washington, D.C.

[21] Appl. No.: 202,631

[22] Filed: Jun. 2, 1988

[51] Int. Cl.[5] ..... C25F 3/24; G06F 15/46

[52] U.S. Cl. ..... 364/188; 364/474.02; 364/474.04; 364/496; 204/129.1; 204/129.2; 204/224 M

[58] Field of Search ..... 364/474.26, 474.02, 364/474.04, 188, 189, 496; 204/129.1, 129.2, 224 M

[56] References Cited

U.S. PATENT DOCUMENTS

| | | | |
|---|---|---|---|
| 4,372,831 | 2/1983 | Rosswag | 204/129.8 |
| 4,446,525 | 5/1984 | Hoch et al. | 364/474 |
| 4,487,671 | 12/1984 | McGeough | 204/129.1 |
| 4,513,366 | 4/1985 | Munekata et al. | 364/167 |
| 4,556,957 | 12/1985 | Ichikawa | 364/171 |
| 4,591,989 | 5/1986 | Tanaka | 364/474 |
| 4,606,007 | 8/1986 | Inoue | 364/474.04 |
| 4,678,976 | 7/1987 | Inoue | 364/184 |
| 4,689,132 | 8/1987 | Haigh | 204/224 M |
| 4,705,611 | 11/1987 | Grimes et al. | 204/129.1 |
| 4,772,372 | 9/1988 | Bruns et al. | 204/224 M |

OTHER PUBLICATIONS

G. F. Vander Voort, Metallography Principles and Practice, McGraw-Hill, New York, pp. 119–125 and pp. 562–609, (1984).

"Metallography and Microstructures," Metals Handbook Ninth Edition, American Society for Metal, Cleveland, OH, pp. 48–56, (1985).

*Primary Examiner*—John R. Lastova

*Attorney, Agent, or Firm*—Benard E. Franz; Donald J. Singer

[57] ABSTRACT

The system described is a computer controlled electropolisher designed to generate the characteristic electropolishing curve and display the data in real time for a given set of conditions. The operator-to-system interface is achieved through menu-driven software which is designed to be user-friendly at all levels of operation. Computer programming skills are not required to operate the system. There are four main program available to the operator from the system main menu. These programs allow the operator to become familiar with the system and its capabilities, access the material and electrolyte libraries, perform an electropolishing experiment under computer control, and recall data from the system data base for analysis, comparison, and graphic presentation.

4 Claims, 4 Drawing Sheets

COMPUTER CONTROLLED ELECTROPOLISHING SYSTEM

RIGHTS OF THE GOVERNMENT

The invention described herein may be manufactured and used by or for the Government of the United States for all governmental purposes without the payment of any royalty.

APPENDIX

Included in the patented file only as an appendix is an "Operating and Service Manual for the SRL/R.A.R.E. Electropolishing System"which includes the computer program listings for the system.

BACKGROUND OF THE INVENTION

The present invention relates generally to a computer controlled electrolyte polishing (electropolishing) system for analytical research.

Electrolytic polishing (electropolishing) can be a useful metallographic specimen preparation technique when properly applied. Electropolishing can remove the mechanical deformation induced from cutting and grinding the specimen resulting in a surface that is unworked from the polishing procedure. For some metals electropolishing can produce a surface finish that is equal to or better than the finish obtainable by mechanical polishing methods. electropolishing technique that yields results for all metals has not been found (See G. F. Vander Voort, *Metallography Principles and Practice,* McGraw-Hill, New York, pp. 119–125 (1984)). The conditions and electrolytes required to obtain the desired surface finish differ of different alloys. There is a wide variety of literature available suggesting electropolishing procedures for various metals, however, the same results are not always achieved when attempting to duplicate these experiments. In addition, developing electropolishing techniques for new alloys using traditional methods requires a considerable amount of time. Other types of sample pareparation (i.e. mechanical) are often employed due to the time consuming and tedious nature of establishing electropolishing procedures.

Using traditional electropolishing techniques, before electropolishing the metallographer must choose the electrolyte composition, the electrolyte temperature, cathode material, anode/cathode area ratio, anode cathode separation, type and degree of agitation, etc. Available literature recommends appropriate parameters for most applications (See "Metallography and Microstructures," Metals Handbook Ninth Edition, American Society for Metals, Cleveland, Ohio pp. 48–56 (1985); and Vander Voort cited above) The polishing region must then be determined for the given set of conditions. This is accomplished by manually varying the voltage on the power supply and monitoring the current until a stable reading is obtained.

FIG. 1 shows the type of plot commonly obtained when using an electrolyte that forms an ionic film on the specimen surface during polishing. Etching occurs at low voltages between (a) and (b); polishing occurs in the Plateau region between (c) and (d); and gas evolution and pitting occurs between (d) and (e) (See Vander Voort, cited above).

Manually generating this characteristic curve while controlling and monitoring the other parameters is a tedious and time consuming task. Also, the curve might reveal that the selected conditions are not suitable for the particular application. This means that the curve must be plotted again for a new set of conditions.

There are U.S. patents of interest in the chemical art relating to the of use of electrolysis for the erosion of a workpiece for shape or surface change; e.g., etching, polishing. etc. U.S. Pat. No. 4,705,611 to Grimes et al is concerned with a method for electropolishing tubes, and U.S. Pat. No. 4,372,831 to Rosswag discloses electrolyte solutions for electropolishing. These patents do not include any suggestion for the use of a computer.

In the electrical computer and data processing art, applications for product manufacturing by machining, there are a number of patents relating to numerical control. Munekata et al (U.S. Pat. No. 4,513,366) disclose a menu programmed machine tool numerical controller operated by a microprocessor connected to a data input device, a CRT display, and data storage. The microprocessor makes various tool and tool path calculations and displays messages on the CRT screen. In Hoch et al (U.S. Pat. No. 4,446,525) a numerical control system executes part programs. A parameter table containing parameter values evaluates parameters and arithmetic expressions during the execution of a part program, and parameter values may be changed by part program instructions or manual data entry. Tanaka (U.S Pat. No. 4,591,989) is concerned with a numerically controlled machining system which stores in a memory a machining program having matching pattern commands for specifying machining patterns, tool commands for specifying tools, and positional information commands for specifying positional information for the tools, Ichikawa (U.S. Pat. No. 4,556,957) shows a numerical control system which includes a display device, a display control device, a data setting device, a memory, a computer, a central processor, and an control device. These patents do not include any suggestion relating to the use of a computer for electropolishing, etching, etc.

SUMMARY OF THE INVENTION

An objective of the invention is to overcome the main disadvantage of electropolishing, that is the time required to develop polishing procedures for new materials which will result in the desired surface finish.

The invention relates to a computer controlled electropolisher constructed to generate a characteristic electropolishing curve and display the data in real time for a given set of conditions. The operator-to-system interface is achieved through menu-driven software and there are five main programs available to the operator from the system's main menu. These five programs allow the operator to become familiar with the system, access the material and electrolyte libraries, add to or change entries in these libraries, perform an electropolishing experiment under computer control, and recall data from the system database for analysis, comparison, and graphic presentation. An operator can generate the required data and polish a specimen to a suitable surface finish in less that thirty minutes.

Electrolytic polishing can be a useful specimen pareparation technique for optical microscopy, electron microscopy, low-load hardness testing, mechanical testing and X-ray studies. The main disadvantage to electropolishing is the time required to develop polishing parameters for new alloys which will result in the desired surface finish. The Metals Characterization Facility AFWAL/MLLS) at Wright-Patterson AFB performs analysis on new and unusual alloys for which suitable electropolishing procedures do not exist. This patent application describes a system which is capable of generating appropriate electropolishing parameters in a timely manner.

The system described is a computer controlled electropolisher designed to generate the characteristic electropolishing curve and display the data in real time for a given set of conditions. This system can generate a characteristic curve in approximately ten minutes, a task that previously required about eight hours of tedious labor. This allows the operator to generate the data required to polish a particular specimen, and then polish that specimen to a suitable surface finish in less than half an hour. The operator-to-system interface is achieved through menu-driven software which is designed to be user-friendly at all levels of operation. Computer programming skills are not required to operate the system.

There are four main programs available to the operator from the system main menu. These programs allow the operator to become familiar with the system and its capabilities, access the material and electrolyte libraries, perform an electropolishing experiment under computer control, and recall data from the system data base for analysis, comparison, and graphic presentation. To illustrate the capabilities of the system, the results obtained from a series of experiments conducted on a Ti-6A-6V-2Sn alloy using the system will be shown. These experiments are designed to display the effects that varying critical electropolishing parameters have on the characteristic electropolishing curve.

BRIEF DESCRIPTION OF THE DRAWING

FIGS. 3, 4, 5 and 6 are CHARACTERISTIC ELECTROPOLISHING CURVES showing current density (A/sq. cm.) versus cell voltage, in which:

FIG. 3 is a graph comprising six curves which show the effects of varying temperatures using 940 mL methanol and 60 mL perchloric acid electrolyte;

FIG. 4 is a graph comprising three curves which show the effects of varying temperatures using 540 mL methanol, 350 mL butylcellosolve, and 60 mL perchloric acid electrolyte;

FIG. 5 is a graph comprising three curves which show the effects of varying anode-cathode separation; and FIG. 6 is a graph which shows comparison of a −80° C. curve using 940 mL methanol, 60 ml perchloric acid electrolyte to a −60° C. curve using 590 mL methanol, 350 mL butylcellosolve, 60 mL perchloric acid electrolyte.

DETAILED DESCRIPTION a New Electropolishing System

Figure 2:
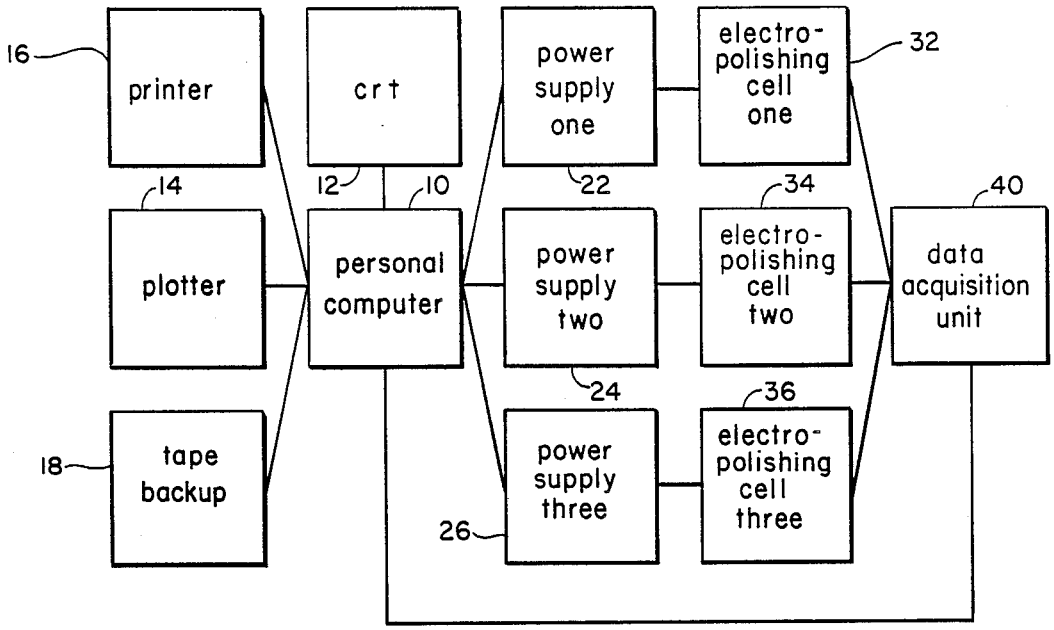
FIG. 2 is a block diagram of the RARE system shown coupled to a typical electropolishing unit.
Figure 2A:
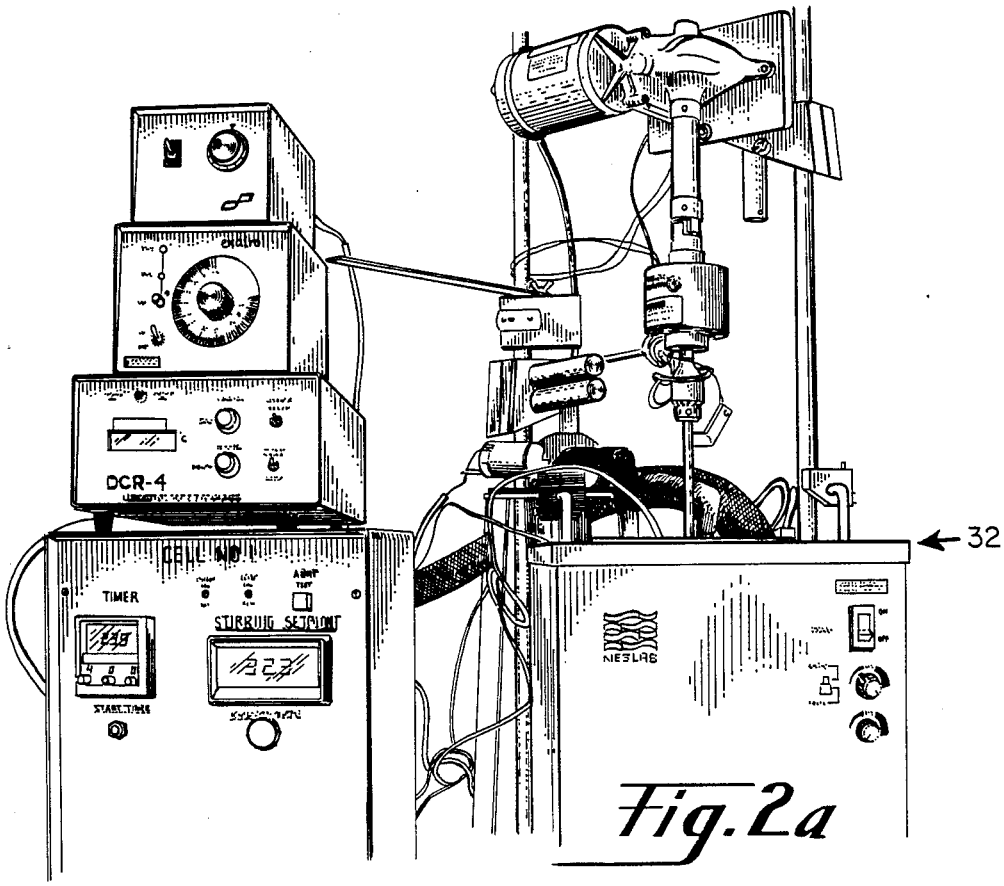
FIG. 2*a* is a pictorial view of a typical electropolishing cell and associated equipment.

A new electropolishing system was designed and built at the Metals Characterization Facility (AFWAL/MLLS), Wright-Patterson Air Force Base. The new system is a three cell computer controlled electropolisher designed to generate the characteristic electropolishing curve, display the data in real time, and provide utilities which are complementary to the overall electropolishing process. As shown by the block diagram of FIG. 2, the system hardware consists of a personal computer 10 equipped with a high resolution color monitor 12 (CRT). GPIB (IEEE-488 standard-general purpose interface bus) adapter, three GPIB programmable power supplies 22, 24 and 26 coupled respectively to three electropolishing cells 32, 34 and 36, a GPIB programmable data acquisition unit 40, a tape drive 18 for backing up data stored on the 30 megabyte capacity hard disk, a six pen color plotter 14, and a dot matrix printer 16. FIG. 2*a* is a pictorial view of a typical electropolishing cell 32 and associated equipment. The operator-to-system interface is achieved through user-friendly menu-driven software so that no computer programming skills are required for operation.

Included herewith as an appendix is an "Operating and Service Manual for the SRL/R.A.R.E. Electropolishing System", which includes the computer program listings for the system. The system was given the name Roper Analytical Research Electropolisher (R.A.R.E.), "Roper" being derived from the names Rowe and Harper.

The system software was written in Fortran and compiled Basic, interfaced to a commercial graphics Package and GPIB driver, and runs under DOS (Disk Operating Systems). The following is a description of the main programs available to the operator from the system's main menu.

THE SYSTEM DESCRIPTION PROGRAM

The system description program provides the operator with a description of the system components and capabilities. It highlights the specifications of the individual components and explains their role in the overall system operation.

THE ELECTROPOLISHING EXPERIMENT PROGRAM

The electropolishing experiment program generates the characteristic curve for a given set of conditions. While an experiment is being conducted all critical parameters are controlled and monitored by the computer. This allows the metallographer to analyze the data while it is being displayed in real time on the CRT.

The program prompts the operator to enter the following parameters: starting voltage, ending voltage, voltage increment, current limit, current sampling interval, stirring setpoint, temperature setpoint, and temperature tolerance. Once the experiment is started, the computer commands the programmable power supply to output a voltage corresponding to the starting voltage entered during setup. An instantaneous current is read followed by current readings at time intervals equal to the current sampling interval specified. Each current reading is plotted on the CRT in real time. A section of program code is executed after each current reading to determine if equilibrium conditions have been reached. Once equilibrium has been achieved for a particular voltage the computer plots a line representing the settled current and commands the power supply to increase the voltage by the increment entered during setup. This process continues until the cell voltage reaches the ending voltage or the experiment is manually aborted. A hard copy of the data is printed out during the experiment so that no data is lost if a system failure occurs. When the experiment is complete the operator has the option of writing the data, including all pertinent parameters, to a file in the system data base.

Figure 1:
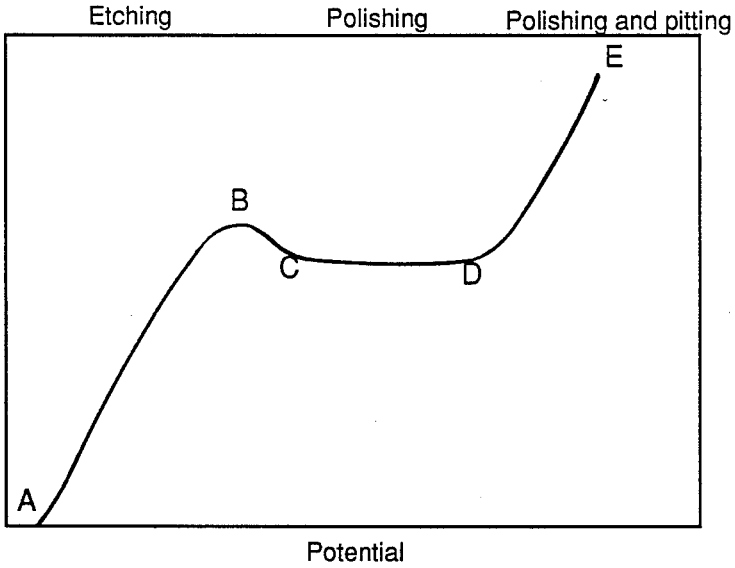
FIG. 1 is a graph which shows a typical plot of current density versus cell potential for electrolytes that form an anodic polishing film on specimen surface during polishing.
Figure 1A:
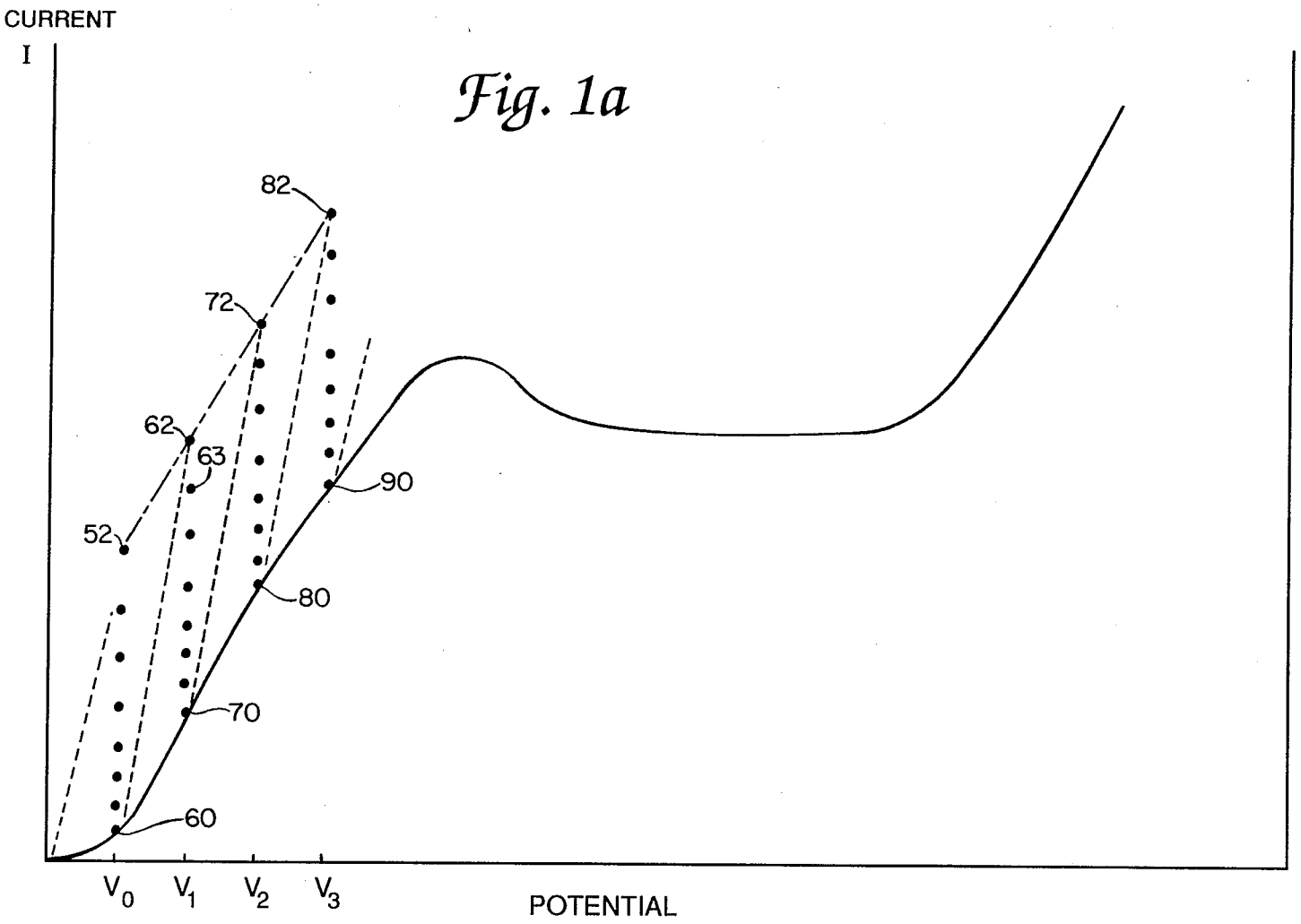
FIG. 1*a* is a graph showing how a plot is generated.

FIG. 1*a* is a graph showing how a plot is generated, in accordance with the operation described above. For example, if the power supply is commanded to supply a voltage such as $V_1$, the computer program provides a short wait for the voltage and current to stabilize, then gives a command to read the current (referred to as "instantaneous current") and causes the value to be plotted on the CRT display as a point shown by the reference character 62. Then the program provides a waiting time interval equal to the current sampling interval parameter, gives a command to read the current again, and the value is plotted as a point 63. After each current reading, its value is compared to the previous reading. The current readings and plotting of points continues spaced in time by the current sampling interval until the comparison of successive current readings indicates that they are equal within a given accuracy, which is the equilibrium condition for the particular voltage $V_1$, and the current at point 70 is designated as the settled current. The computer then plots the line from the previous settled current point 60 up to point 70. A command is given to increase the voltage of the power supply by the voltage increment parameter to a value shown as $V_2$. The operation is then repeated to read and plot current values from the instantaneous value at point 72 down to a settled value at point 80, and to generate the line segment from point 70 to point 80. This process continues until the cell voltage reaches the ending voltage or the experiment is manually aborted. There is also a plot made for the "instantaneous" current values along the line 52-62-72-82-etc.

THE DATA BASE/ANALYSIS PROGRAM

The data base/analysis program provides access to data stored in the system data base. This program has the capability to preferentially search the existing data files with respect to work order number, initiating engineer, electrolyte composition, and material composition. This allows the operator to analyze a particular file or group of files. The data base can hold 10,000 files on line (hard disk) and an unlimited number on diskette. Another feature of this program is the capability to output experimental results in graphic form. Data from up to six files can be plotted on the same graph for comparison. These graphs can be output to the CRT or the plotter. The plotter produces high-quality viewgraphs if transparency film is used.

THE ELECTROLYTE AND MATERIAL LIBRARY PROGRAM

This program provides a list of suggested electrolytes for polishing various metal alloys. It also affords access to an extensive list of electrolytes, their chemical compositions, and the safety precautions which pertain to their use. By choosing the appropriate menu option the operator can view the information on the CRT or obtain a hard copy from the printer. Similar functions are available for the material library. The edit feature allows the operator to add, delete, or change entries in the electrolyte and material library files.

RESULTS OBTAINED USING THE NEW SYSTEM

The following graphs show how the characteristic electropolishing curve is affected by varying the electrolyte temperature, the electrolyte composition, and the anode cathode separation. All twelve of these experiments were conducted in one day. The specimens used for these experiments were a Ti-6Al-6V-2Sn alloy ground to a 600-grit finish. The surface areas for the specimen and stainless steel cathode were 5.07 $cm^2$ and 37.2 $cm^2$ respectively.

Figure 3:
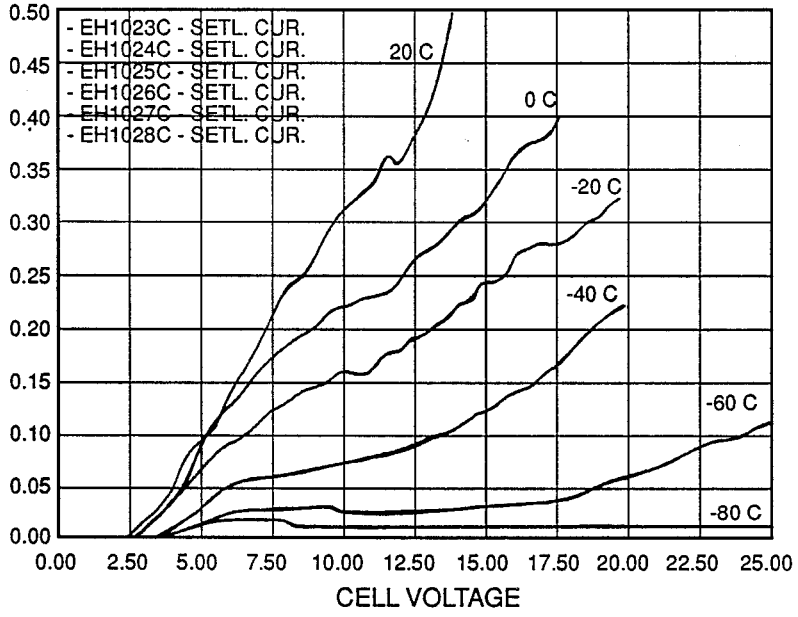
Figure 4:
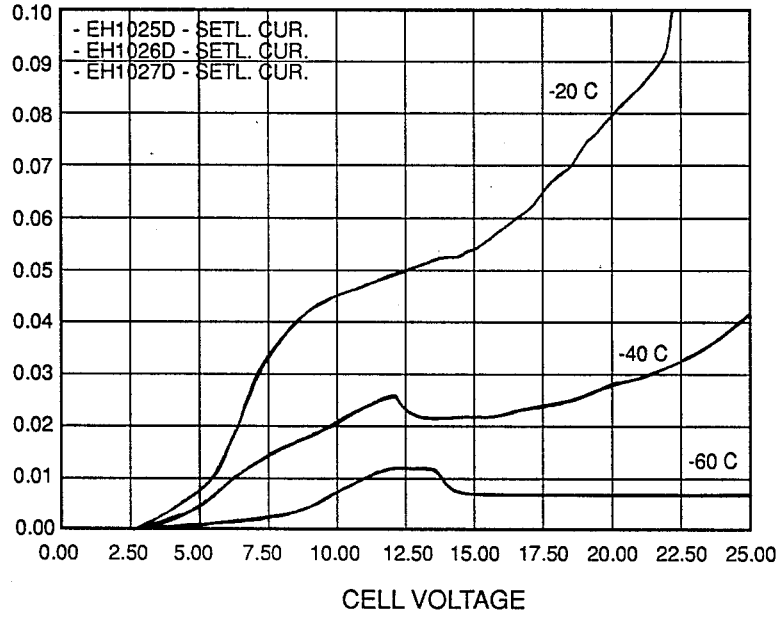

FIG. 3 shows six curves that were generated for electrolyte temperatures of 20°, 0°, −20, −40°, −60°, and −80° C. The electrolyte composition used for these experiments was 940 mL methanol, 60 Ml percholic acid, and the anode-cathode separation was 2.54 cm. FIG. 4 shows three curves generated for electrolyte temperatures of −20°, −40°, and −60° C. The electrolyte composition used for these experiments was 590 mL methanol, 350 mL butylcellosolve, 60 mL perchloric acid, and the anode cathode separation was 2.54 cm.

Figure 5:
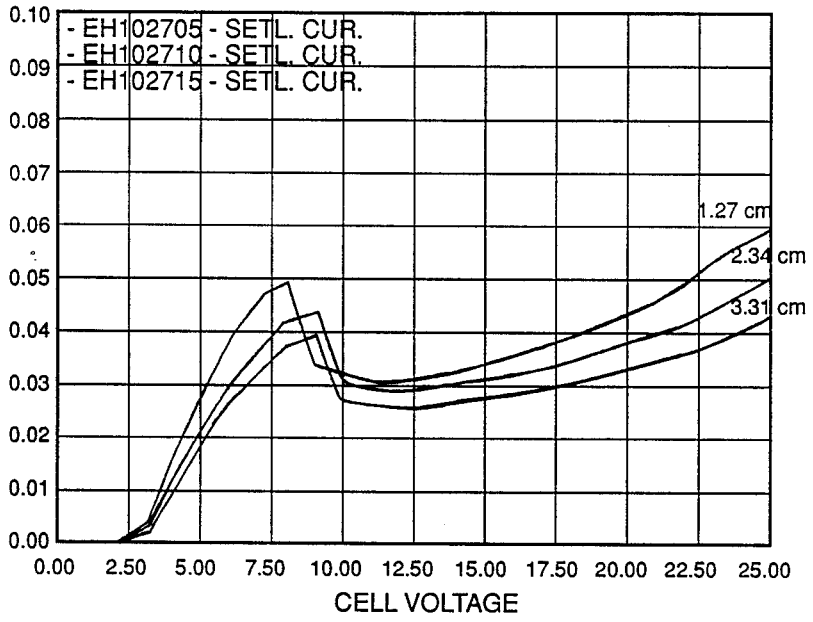

FIG. 5 shows three curves generated for anode cathode separations of 1.27, 2.54, and 3.81 cm. The electrolyte composition used for these experiments was 940 mL methanol, 60 mL perchloric acid, and the electrolyte temperature was −50° C.

DISCUSSION OF RESULTS

The six plots in FIG. 3 show how varying the electrolyte temperature affects the characteristic electropolishing curve. Notice that only the −60 and −80 degree Celsius curves show a well defined polishing plateau. Also, note that the polishing plateau widens and the current density in the plateau region decreases as the temperature is decreased.

The three plots in FIG. 4 show the effect of varying the elctrolyte temperature for a different electrolyte composition. The addition of the butylcellosolve makes the electrolyte more viscous which appears to aid the formation of the anodic polishing layer. This means that a wide polishing plateau can be achieved at a higher electrolyte temperature thus reducing the cooling bath requirements. Note that the results obtained at −60° C. with butylcellosolve compare to those obtained at a temperature of −80° C. with butylcellosolve compare to those obtained at a temperature of −80° C. without this addition.

The three plots in FIG. 5 show the effect of varying the anode cathode separation. Notice that the curve shifts to the right and the plateau current density decreases as the anode cathode separation increases.

Electropolishing is a useful specimen preparation technique for certain applications, however, developing procedures that produce satisfactory results can be a tedious and time consuming task. A computer-controlled system has been developed which greatly enhances the generation of electropolishing procedures in addition to providing other utilities complementary to the overall process. The results presented in this paper illustrate how experimental parameters can be varied and the results analyzed in a timely manner using the new system.

Figure 6:
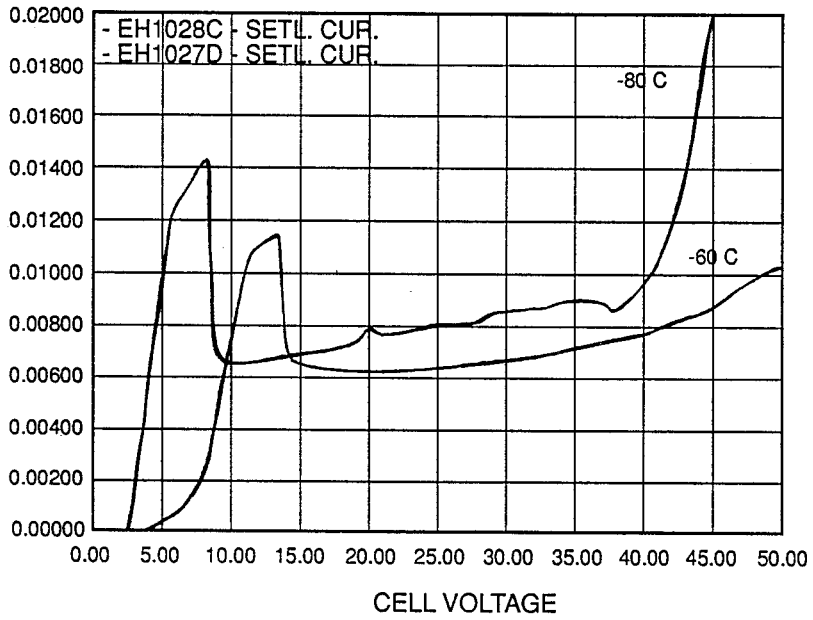

FIG. 6 is a graph which shows comparison of a −80° C. curve using 940 mL methanol, 60 ml perchloric acid electrolyte to a −60° C. curve using 590 mL methanol, 350 mL butylcellosolve, 60 mL perchloric acid electrolyte.

It is understood that certain modifications to the invention as described may be made, as might occur to one with skill in the field of the invention, within the scope of the appended claims. Therefore, all embodiments contemplated hereunder which achieve the objectives of the present invention have not been shown in complete detail. Other embodiments may be developed without departing from the scope of the appended claims.

What is claimed is:

1. An electropolishing system using a computer with display means, for control of a cell in which a specimen is electropolished using a selected electrolyte, a programmable power supply having an interface with the computer, the power supply being coupled to said cell to supply selected values of voltage to cause current flow through the cell which is sensed via the interface means, and program means which includes an electropolishing experiment program means for generating a characteristic curve for a given set of conditions;

wherein said electropolishing experiment program means includes means for entering the following parameters: starting voltage, ending voltage, voltage increment, current limit, current sampling interval, stirring setpoint, temperature setpoint, and temperature tolerance;

command means for commanding the programmable power supply via said interface to output a voltage corresponding to said starting voltage;

characteristic curve generating means for plotting a current versus voltage graph, including means for reading a first value of current via said interface, followed by current readings at time intervals equal to said current sampling interval, means for plotting each current reading as a point on said display means in real time, means executed after each current reading to determine if equilibrium conditions have been reached as indicated by successive current readings being equal within a given accuracy, the value then being designated as a settled current value, means effective once equilibrium has been achieved for a particular voltage for plotting a line on said display means representing the settled current value and for commanding the power supply to increase the voltage by said voltage increment;

means for causing repeated operation of said characteristic curve generating means for each voltage increment until the voltage reaches said ending voltage;

and means for aborting the experiment before said ending voltage is reached.

2. An electropolishing system according to claim 1, wherein the program means further includes system description program means, electrolyte and material library program means, and data base/analysis program means, along with main menu means providing selection from among the following options: (a) description of the system, (b) access electrolyte/material library, (c) run experiment program, (d) run data base/analysis program, and (e) edit electrolyte/material library;

wherein said electropolishing experiment program means includes means effective while an experiment is being conducted for controlling and monitoring all critical parameters, to thereby allow the operator (metallographer) to analyze the data while it is being displayed in real time on the display means;

wherein the data base/analysis program means provides access to data stored in s system data base, with means for preferentially searching existing data files with respect to work order number, initiating engineer, electrolyte composition, and material composition, which allows the operator to analyze a particular file or group of files, wherein said data base/analysis program means includes means to output experimental results is graphic form to said display means, with data from a plurality of files plotted on the same graph for comparison, wherein the display means comprises a CRT and a plotter, and the output in graphic form may be to either the CRT or the plotter.

3. An electropolishing system according to claim 2, wherein the electrolyte and material library program means comprises memory means and processing means for providing a list of suggested electrolytes for polishing various metal alloys, and also affords access to an extensive list of electrolytes, the chemical compositions of the electrolytes, and the safety precautions which pertain to the use of the electrolytes, with menu selection means, so that by choosing the appropriate menu option the operator can view the information on the CRT or obtain a hard copy from a printer, and edit means for allowing the operator to add, delete, or change entries in the electrolyte and material library files.

4. A system for providing data for erosion of a workpiece for shape or surface change, using a computer with display means, a programmable power supply coupled to said cell and having an interface with the computer, program means which includes an experiment program means for generating a characteristic curve for a given set of conditions;

wherein said experiment program means includes means for entering the following parameters: starting voltage, ending voltage, voltage increment, current limit, and current sampling interval;

command means for commanding the programmable power supply to output a voltage corresponding to said starting voltage;

characteristic curve generating means for plotting a current versus voltage graph, including means for reading a first value of current via said interface, followed by current readings at time intervals equal to said current sampling interval, means for plotting each current reading as a point on said display means in real time, means executed after each current reading to determine if equilibrium conditions have been reaches as indicated by successive current readings being equal within a given accuracy, the value then being designated as a settled current value, means effective once equilibrium has been achieved for a particular voltage for plotting a line on said display means representing the settled current value and for commanding the power supply to increase the voltage by said voltage increment;

means for causing repeated operation of said characteristic curve generating means for each voltage increment until the voltage reaches said ending voltage.

* * * * *

UNITED STATES PATENT AND TRADEMARK OFFICE

CERTIFICATE OF CORRECTION

PATENT NO. : 4,935,865

DATED : June 19, 1990

INVENTOR(S) : Mark S. Rowe et al

It is certified that error appears in the above-identified patent and that said Letters Patent is hereby corrected as shown below:

Col 1, line 29, "methods. electropolishing" should be ---methods. A universal electropolishing---.

Col 1, line 30, "yields results" should be ---yields satisfactory results---.

Col 1, line 34, "of" should be ---for---.

Col 1, line 62, "Plateau" should be ---plateau---.

Col 2, line 36, "and an control" should be ---and an output control---.

Col 6, line 38, "elctrolyte" should be ---electrolyte---.

Col 6, line 53, before "Electropolishing", the heading ---SUMMARY--- should be inserted and centered.

Col 8, claim 2, line 4, "s" should be ---a---.

Col 8, claim 4, line 23, "reaches" should be ---reached---.

Signed and Sealed this

Tenth Day of December, 1991

*Attest:*

HARRY F. MANBECK, JR.

*Attesting Officer*

*Commissioner of Patents and Trademarks*